US005332514A

United States Patent [19]

Kreuz et al.

[11] Patent Number: 5,332,514

[45] Date of Patent: Jul. 26, 1994

[54] CONTINUOUS PROCESS FOR PREPARING OVERBASED SALTS

[75] Inventors: Kenneth L. Kreuz, Cold Spring; Tze-Chi Jao, Fishkill; Brian L. Papke, Wappingers Falls; Edward R. Arndt, Glenham, all of N.Y.

[73] Assignee: Texaco Inc., White Plains, N.Y.

[21] Appl. No.: 563,600

[22] Filed: Aug. 6, 1990

[51] Int. Cl.[5] ..... C10M 135/10

[52] U.S. Cl. ..... 252/25; 252/18; 252/33; 252/33.4

[58] Field of Search ..... 252/18, 25, 33.4, 33, 252/39

[56] References Cited

U.S. PATENT DOCUMENTS

| | | | |
|---|---|---|---|
| 3,320,162 | 5/1967 | Axe et al. | 252/33 |
| 3,377,283 | 4/1968 | McMillen | 242/39 |
| 3,437,595 | 4/1969 | Coupland | 252/42.7 |
| 3,658,703 | 4/1972 | Gragson et al. | 252/33 |
| 3,769,213 | 10/1973 | Ross | 252/33 |
| 4,302,342 | 11/1981 | Demoures et al. | 252/39 |
| 4,541,940 | 9/1985 | Spence | 252/33 |
| 4,929,373 | 5/1990 | Powers et al. | 252/25 |
| 4,954,272 | 9/1990 | Jao et al. | 252/39 |
| 4,973,411 | 11/1990 | Jao et al. | 252/39 |
| 4,995,993 | 2/1991 | Papke et al. | 252/33 |

*Primary Examiner*—Margaret Medley

[57] ABSTRACT

A continuous method of preparing an overbased calcium sulfonate which comprises repeating the following steps until a desired TBN is obtained, said method comprising: (a) contacting Ca $(OH)_2$ and methanol with a normal calcium sulfonate hydrocarbon solution to solubilize at least a portion of the $Ca(OH)_2$; (b) filtering the sulfonate solution to separate and remove the non-solubilized $Ca(OH)_2$ from the solubilized $Ca(OH)_2$ contained in an obtained sulfonate filtrate; (c) treating said sulfonate filtrate with gaseous $CO_2$ to convert the solubilized $CA(OH)_2$ to solubilized $CaCO_3$; (d) blowing said solubilized $CaCO_3$ with an inert gas to remove therefrom any excess $CO_2$ and the aqueous phase generated therein to obtain an overbased sulfonate liquid; (e) adding more of said normal calcium sulfonate solution to said overbased sulfonate liquid and contacting said overbased sulfonate liquid with said non-solubilized $Ca(OH)_2$ and additional fresh $Ca(OH)_2$ to obtain an overbased sulfonate liquid product; (f) repeating steps (b) through (e) until the desired TBN of the sulfonate liquid product is obtained, and removing an amount of sulfonate liquid product after step (d) equal to the additions of normal calcium sulfonate and $Ca(OH)_2$ in step (e); and (g) stripping the methanol and hydrocarbon solvent from the sulfonate liquid removed after step (d) to obtain the overbased calcium sulfonate product.

7 Claims, No Drawings

CONTINUOUS PROCESS FOR PREPARING OVERBASED SALTS

BACKGROUND OF THE INVENTION

This invention relates to overbased calcium sulfonates, and more particularly to an improved process for continuously preparing overbased calcium sulfonates which are used as detergent and reserve alkalinity in lubricating oil additives.

Highly basic calcium sulfonates are commonly used in lubricating oils; the materials consist of a colloidal dispersion of amorphous calcium carbonate in oil. A calcium sulfonate surfactant acts to disperse and stabilize the calcium carbonate. When used as an automotive crankcase lubricant additive, these materials function to neutralize acids formed during normal engine operation. Thus, the solubilized base performs an essential function, neutralizing acidic deposit precursors and sulfur acids originating from both combustion by-products and lubricant oil oxidation.

Highly basic calcium sulfonate lubricant additives are prepared from oil-soluble sulfonic acids (M.W. ca 350–600) obtained from the sulfonation of either high boiling petroleum distillate fractions or synthetic alkylenzenes. In a hydrocarbon medium, alkaline earth sulfonates are known to form inverted micellar aggregates, and contain a polar core of solubilized inorganic base (calcium carbonate and calcium hydroxide) stabilized by an adsorbed layer of the calcium sulfonate surfactant. Through a process known as "overbasing", the amount of solubilized base may be increased to as high as 30 moles of base per mole of alkaline earth sulfonate.

Overbased calcium sulfonates are generally produced by carbonating a hydrocarbon solution of a "neutral" calcium sulfonate or sulfonic acid, a calcium base (usually calcium hydroxide and/or calcium oxide), and certain reaction promoters such as lower alcohols, especially methanol, and/or calcium chloride. During the reaction the calcium base reacts with gaseous carbon dioxide to form calcium carbonate. The calcium carbonate is incorporated into small inverted micellar structures during this process. These basic calcium sulfonate micelles effectively render the calcium base oil soluble, an essential step for this product to be useful in lubricating oil formulations. The final product must be filtered or centrifuged to remove unreacted solids, particularly since an excess of the calcium base is used in the production of highly basic sulfonates.

Economically, it is useful to obtain a product which is as highly basic as possible. However, as the basicity increases, product viscosity tends to increase and filtration rates decrease. Thus, an object of the present invention is to provide a continuous process to prepare overbased alkaline earth sulfonates (300–500 TBN range) having acceptable filterability and viscosity.

DISCLOSURE STATEMENT

U.S. Pat. No. 4,541,938 discloses a method and apparatus for the continuous overbasing of petroleum sulfonate providing a process in which $CO_2$ is contacted with a reaction mixture of neutral petroleum sulfonate, lube oil stock, lime, methanol, and naphtha in a series of reaction vessels in which additional $CO_2$ is contacted with succeeding reaction vessel containing the effluent from the preceding reaction vessel, a method and apparatus for the removal of at least a portion of the effluent from each reaction vessel with the reduction of water content in this portion and subsequent supplementing of methanol content in this portion to provide a suitable amount of water and methanol in each succeeding reaction.

U.S. Pat. No. 4,427,559 discloses that a mixture of calcium oxide and calcium hydroxide can be used in the overbased reaction to provide reserve alkalinity to neutral calcium sulfonates. It is reported that when mixtures containing up to 30 percent are used, satisfactory products were obtained. When mixtures of 30 to 50 percent CaO were used, a gelatinous material which plugged the filter were obtained. Concentrations of CaO above 70 percent produced a fluid product containing finely divided particles which filtered easily but were reflective of light (i.e. extremely hazy). In this regard, the patent teaches the criticality of the ratio of the calcium oxide to calcium hydroxide in the absence of a promoter in producing acceptable product.

U.S. Pat. No. 4,604,219 discloses that calcium oxide may be used as the sole reserve alkalinity source in overbasing calcium sulfonates. This patent teaches, in the absence of a promoter, that water addition rate and amount are critical in producing a low solids content, filterable product.

U.S. Pat. No. 4,086,170 discloses that overbased calcium sulfonates are prepared by reacting a solution of alkylbenzene sulfonic acids with an excess of a calcium oxide having a medium or low activity toward water and with carbon dioxide. Improved overbasing and filterability of the overbased sulfonate solution were obtained by the use of a promoter for the conversion of the calcium oxide to calcium hydroxide. Recommended promoters include ammonia or organic bases such as monoamines or diamines, e.g. ethylene diamine.

U.S. Pat. No. 4,880,550 discloses a method for preparing a carbonate overbased calcium sulfonate, which method comprises the steps of: (1) forming an initial mixture of a lower molecular weight alkanol, an alkyl or alkaryl substituted sulfonic acid or sulfonate compound, a diluent and a solvent; (2) adding a basic calcium compound to the initial mixture to form a second mixture in which the amount of added calcium is at least about ten times the amount necessary to form a neutral calcium sulfonate; (3) heating the second mixture to reflux temperature; (4) carbonating the second mixture at said reflux temperature to form a carbonated product while simultaneously and continuously removing water produced by the carbonation reaction; (5) after carbonation is stopped, heating the carbonated product to an elevated temperature sufficient to remove the alkanol; and (6) removing solids and solvent form the carbonated product.

Co-pending U.S. patent application, Ser. No. 07/329,129 discloses a method of preparing a calcium sulfonate having a TBN of 325 where the method comprises reacting CaO, $Ca(OH)_2$ and $H_2O$ in certain molar ratios for a sufficient length of time to produce the overbased calcium sulfonate.

SUMMARY OF THE INVENTION

The present invention provides a continuous method of preparing an overbased calcium sulfonate which comprises repeating the following steps until a desired TBN is obtained. The method comprises:

(a) contacting $Ca(OH)_2$ and methanol with a normal calcium sulfonate hydrocarbon solution to solubilize at least a portion of the $Ca(OH)_2$;

(b) filtering the sulfonate solution to separate and remove the non-solubilized $Ca(OH)_2$ from the solubilized $Ca(OH)_2$ contained in an obtained sulfonate filtrate;

(c) treating said sulfonate filtrate with gaseous $CO_2$ to convert the solubilized $CA(OH)_2$ to solubilized $CaCO_3$;

(d) blowing said solubilized $CaCO_3$ with an inert gas to remove therefrom any excess $CO_2$ and the aqueous phase generated therein to obtain an overbased sulfonate liquid;

(e) adding more of said normal calcium sulfonate solution to said overbased sulfonate liquid and contacting said overbased sulfonate liquid with said non-solubilized $Ca(OH)_2$ and additional fresh $Ca(OH)_2$ to obtain an overbased sulfonate liquid product;

(f) repeating steps (b) through (e) until the desired TBN of the sulfonate liquid product is obtained, and removing an amount of sulfonate liquid product after step (d) equal to the additions of normal calcium sulfonate and $Ca(OH)_2$ in step (e); and (g) stripping the methanol and hydrocarbon solvent from the sulfonate liquid removed after step (d) to obtain the overbased calcium sulfonate product.

DETAILED DESCRIPTION OF THE INVENTION

According to the present invention, an overbased salt (e.g., a calcium sulfonate) is prepared by a continuous process wherein the steps are repeated until a desired Total Base Number (TBN) is obtained for the overbased salt.

The method of continuously preparing an overbased calcium sulfonate comprises repeating the following steps until a desired TBN is obtained; the method comprises:

(a) contacting $Ca(OH)_2$ and methanol with a normal calcium sulfonate hydrocarbon solution to solubilize at least a portion of the $Ca(OH)_2$;

(b) filtering the sulfonate solution to separate and remove the non-solubilized $Ca(OH)_2$ from the solubilized $Ca(OH)_2$ contained in an obtained sulfonate filtrate;

(c) treating said sulfonate filtrate with gaseous $CO_2$ to convert the solubilized $CA(OH)_2$ to solubilized $CaCO_3$;

(d) blowing said solubilized $CaCO_3$ with an inert gas to remove therefrom any excess $CO_2$ and the aqueous phase generated therein to obtain an overbased sulfonate liquid;

(e) adding more of said normal calcium sulfonate solution to said overbased sulfonate liquid and contacting said overbased sulfonate liquid with said non-solubilized $Ca(OH)_2$ and additional fresh $Ca(OH)_2$ to obtain an overbased sulfonate liquid product;

repeating steps (b) through (e) until the desired TBN of the sulfonate liquid product is obtained, and removing an amount of sulfonate liquid product after step (d) equal to the additions of normal calcium sulfonate and $Ca(OH)_2$ in step (e); and (g) stripping the methanol and hydrocarbon solvent from the sulfonate liquid removed after step (d) to obtain the overbased calcium sulfonate product.

In the present process for overbasing calcium sulfonates, a normal calcium sulfonate in solution with a ($C_5$–$C_8$) hydrocarbon and a ($C_1$–$C_2$) alcohol is contacted with Ca $(OH)_2$. The preferred hydrocarbon is heptane and the preferred alcohol is methanol.

Also, according to the present invention, a low-based calcium phenate may be used in substitution of the normal calcium sulfonate.

The contacted sulfonate is then filtered to provide a sulfonate filtrate containing solubilized $Ca(OH)_2$. The solubilized $Ca(OH)_2$ is treated with a gaseous $CO_2$ to provide an overbased sulfonate liquid product.

Then, in order to have an overbased calcium sulfonate of a desired TBN, the process is repeated until the desired TBN of the sulfonate liquid product is obtained. The TBN may be at any level and is generally in the range of about 200 to about 500.

In the process the normal calcium sulfonate is contacted with $Ca(OH)_2$ at a temperature ranging from about 60° C. to about 100° C. The sulfonate is in solution preferably with heptane and methanol.

The sulfonate filtrate is treated with a stoichiometric amount of gaseous $CO_2$. That is, the sulfonate filtrate is treated with a gaseous $CO_2$ in a mole ratio of $CO_2$ to sulfonate of about 1.0:1.0.

After the $CO_2$ treatment of the sulfonate filtrate, the filtrate is purged with nitrogen ($N_2$) to remove the $CO_2$ from the sulfonate filtrate.

The advantages of the present invention are more clearly apparent when considering the following example and results thereof.

EXAMPLE I

Two-Stage Overbasing Procedure For Detergents

A blend containing 100 parts by weight of a normal calcium sulfonate, plus 140 parts (range 100–180) heptane plus 6.8 parts (range 5–8) methanol plus 1.0 parts (range 0.5–1.5) water was contacted with 82 parts calcium hydroxide at 60° C. (range 50°–70° C.) for 5 minutes (range 3–7 min.). The liquid and solid phases were separated by filtration (alternately by sedimentation/centrifugation). The liquid phase was contacted with $CO_2$ (200 ml/min) for 3 min. (range 1–5) min.) The product was briefly purged with nitrogen, and the very small amount of generated aqueous phase removed and discarded. This was the end of Stage I.

The liquid product from Stage I was adjusted to its original methanol content (by 1020 $CM^{-1}$ IR band) was contacted with the above solids from Stage I, using the same conditions as Stage I, and continued with the same procedure to yield a liquid and solid product from Stage II. After 18 stages the liquid product after solvent stripping showed a Total Base Number of 245 and 10.0% Ca.

In the same procedure as above a 300 TBN overbased calcium sulfonate was employed in place of normal calcium sulfonate. After 5 stages the liquid product after solvent stripping showed a TBN value of 414 ck.426. Again using the same procedure, an overbased sulfurized calcium phenate (TBN=184) was employed in place of normal calcium sulfonate. After 6 stages the stripped product gave a TBN (ASTM D2896) of 310.

Although not available as an example, a preferred general procedure for the two-step process would consist of a continuous process wherein the blend containing detergent (e.g., sulfonate, phenate) plus heptane, methanol and water was charged first through a bed of $CA(OH)_2$, then a continuous centrifuge to remove any suspended fines, then through a percolation-type $CO_2$ contactor, then through a nitrogen purge and finally into a small settling chamber where the small amount of water phase is drawn off, and any necessary methanol make-up added before returning to the $Ca(OH)_2$ bed via a peristaltic-type pump. When the TBN reaches the desired value, product is continuously drawn off and new detergent charged as required to maintain the desired TBN level.

We claim:

1. A continuous method of preparing an overbased calcium sulfonate which comprises repeating the following steps until a desired TBN is obtained, said method comprising:

(a) contacting $Ca(OH_2$ and methanol with a normal calcium sulfonate hydrocarbon solution at a temperature ranging from about 60° C. to about 100° C. to solubilize at least a portion of the $Ca(OH)_2$;

(b) filtering the sulfonate solution to separate and remove the non-solubilized $Ca(OH)_2$ from the solubilized $Ca(OH)_2$ contained in an obtained sulfonate filtrate;

(c) treating said sulfonate filtrate with gaseous $CO_2$ in a mole ratio of $CO_2$ to sulfonate of about 1.0:1.0 to convert the solubilized $CA(OH)_2$ to solubilized $CACO_3$;

(d) blowing said solubilized $CaCO_3$ with nitrogen to remove therefrom any excess $CO_2$ and the aqueous phase generated therein to obtain an overbased sulfonate liquid;

(e) adding more of said normal calcium sulfonate solution to said overbased sulfonate liquid and contacting said overbased sulfonate liquid with said non-solubilized $Ca(CO)_2$ and additional fresh $Ca(OH)_2$ to obtain an overbased sulfonate liquid product;

(f) repeating steps (b) through (e) until the desired TBN ranging from about 200 to about 500 of the sulfonate liquid product is obtained, and removing an amount of sulfonate liquid product after step (d) equal to the additions of normal calcium sulfonate and $Ca(OH)_2$ in step (e); and (g) stripping the methanol and hydrocarbon solvent from the sulfonate liquid removed after step (d) to obtain the overbased calcium sulfonate product.

2. The method of claim 1 wherein said sulfonate filtrate is treated with a stoichiometric amount of $CO_2$.

3. The method of claim 1 wherein said calcium sulfonate is in solution with a ($C_5$–$C_8$) hydrocarbon and a ($C_1$–$C_2$) alcohol.

4. The method of claim 1 or 3, wherein the ($C_1$–$C_2$) alcohol level in the sulfonate is adjusted by the addition thereto of said alcohol when the excess $CO_2$ is removed.

5. The method of claim 3 wherein said hydrocarbon is heptane and said alcohol is methanol.

6. The method of claim 1 wherein said excess $CO_2$ is removed by purging said treated sulfonate filtrate with $N_2$.

7. A continuous method of preparing an overbased calcium phenate which comprises repeating the following steps until a desired TBN is obtained, said method comprises:

(a) contacting $Ca(OH)_2$ and methanol with a low-based calcium phenate hydrocarbon solution at a temperature ranging from about 60° C. to about 100° C. to solubilize at least a portion of the $Ca(OH)_2$;

(b) filtering the phenate solution to separate and remove the non-solubilized $Ca(OH)_2$ from the solubilized $CA(OH)_2$ contained in an obtained phenate filtrate;

(c) treating said phenate filtrate with gaseous $CO_2$ in a mole ratio of $CO_2$ to sulfonate of about 1.0:1.0 to convert the solubilized $Ca(OH)_2$ to solubilized $CaCO_3$;

(d) blowing said solubilized $CaCO_3$ with nitrogen to remove therefrom any excess $CO_2$ and the aqueous phase generated therein to obtain an overbased phenate liquid;

(e) adding more of said low-based calcium phenate solution to said overbased phenate liquid and contacting said overbased phenate liquid with said non-solubilized $Ca(OH)_2$ and additional fresh $Ca(OH)_2$ to obtain an overbased phenate liquid product;

(f) repeating steps (b) through (e) until the desired TBN ranging from about 200 to about 500 of the phenate liquid product is obtained, and removing an amount of phenate liquid product after step (d) equal to the additions of low-based calcium phenate and $Ca(OH)_2$ in step (e); and (g) stripping the methanol and hydrocarbon solvent form the phenate liquid removed after step (d) to obtain the overbased calcium phenate product.

* * * * *